US008181741B2

(12) United States Patent
Lee

(10) Patent No.: US 8,181,741 B2
(45) Date of Patent: May 22, 2012

(54) LIFE SAVING IMPLEMENT

(75) Inventor: Hyun-Dal Lee, Seoul (KR)

(73) Assignee: Implement Saving Precious Life Co., Ltd. (KR)

( * ) Notice: Subject to any disclaimer, the term of this patent is extended or adjusted under 35 U.S.C. 154(b) by 1016 days.

(21) Appl. No.: 11/574,306

(22) PCT Filed: Aug. 25, 2005

(86) PCT No.: PCT/KR2005/002802

§ 371 (c)(1),
(2), (4) Date: Feb. 26, 2007

(87) PCT Pub. No.: WO2006/022519

PCT Pub. Date: Mar. 2, 2006

(65) Prior Publication Data

US 2007/0246694 A1 Oct. 25, 2007

(30) Foreign Application Priority Data

Aug. 27, 2004 (KR) ..... 10-2004-0068186

(51) Int. Cl.
*B66B 11/08* (2006.01)

(52) U.S. Cl. ..... 182/70; 182/71; 182/73; 182/236; 187/259; 187/263; 187/264

(58) Field of Classification Search ..... 182/3, 4, 182/70–73, 82, 141, 142, 150, 236, 239, 182/240; 187/239, 259, 263, 264, 350; 242/364, 242/365.4

See application file for complete search history.

(56) References Cited

U.S. PATENT DOCUMENTS

| | | | | | |
|---|---|---|---|---|---|
| 260,422 | A | | 7/1882 | Röhmer | |
| 916,823 | A | * | 3/1909 | Young | 182/235 |
| 1,141,995 | A | * | 6/1915 | Upton | 182/237 |
| 2,274,000 | A | * | 2/1942 | Sahlin | 187/376 |
| 4,290,503 | A | * | 9/1981 | Briles | 182/47 |
| 4,406,351 | A | * | 9/1983 | Littlejohn et al. | 182/47 |
| 4,457,400 | A | * | 7/1984 | Donaldson et al. | 182/234 |
| 4,653,609 | A | * | 3/1987 | Devine | 182/238 |
| 4,702,348 | A | * | 10/1987 | Lew et al. | 182/42 |

(Continued)

FOREIGN PATENT DOCUMENTS

JP 42-000595 1/1967

(Continued)

OTHER PUBLICATIONS

International Search Report PCT/KR2005/002802 dated Oct. 27, 2005 (Korean Patent Office).

(Continued)

*Primary Examiner* — Katherine w Mitchell
*Assistant Examiner* — Colleen M Chavchavadze
(74) *Attorney, Agent, or Firm* — Ostrolenk Faber LLP

(57) ABSTRACT

A life saving implement includes a prime motor assembly, a winding drum installing in the prime motor assembly to wind a wire rope, a braking drum installed on a side of the winding drum to control an RPM of the winding drum, a braking unit installed on a lower portion of the braking drum to control an RPM of the braking drum, a speed reduction unit installed on an upper portion of the braking drum to gradually reduce the RPM of the winding drum until the winding drum stops, and a passenger vehicle moving by the rotations of the winding drum and the braking drum.

13 Claims, 20 Drawing Sheets

U.S. PATENT DOCUMENTS

| | | | | |
|---|---|---|---|---|
| 4,730,703 | A * | 3/1988 | Neuendorf | 182/235 |
| 5,127,491 | A * | 7/1992 | Just-Buddy | 182/142 |
| 5,890,565 | A * | 4/1999 | Wang | 187/263 |
| 6,561,318 | B1 * | 5/2003 | Lamb | 187/263 |
| 7,392,885 | B2 * | 7/2008 | Wang | 187/263 |

FOREIGN PATENT DOCUMENTS

| | | |
|---|---|---|
| JP | 49-130099 | 12/1974 |
| JP | 51-018192 | 2/1976 |
| JP | 58-157476 | 9/1983 |
| JP | 58-177673 | 10/1983 |
| JP | 61-36645 | 3/1986 |
| JP | 63-079674 | 4/1988 |
| JP | 3065829 | 11/1999 |
| KR | 20-0357393 | 7/2004 |

OTHER PUBLICATIONS

Office Action issued by the Japanese Patent Office on Jul. 6, 2009 in connection with corresponding Japanese Patent Application No. 2007-529695.

Translation of Office Action issued by the Japanese Patent Office on Jul. 6, 2009 in connection with corresponding Japanese Patent Application No. 2007-529695.

Letter from Japense Associate to Korean Associate enclosing Japanese Office Action.

Office Action issued by the Korean Patent Office on Aug. 23, 2010 in connection with corresponding Korean Patent Application No. 2007-529695.

Partial English translation of Korean Office Action issued in connection with Korean Patent Application No. 2007-529695 on Aug. 23, 2010.

Decision of Grant issued by the Japanese Patent Office on Dec. 20, 2010 in connection with corresponding Japanese Patent Application No. 2007-529695.

Search Report issued by Australian Patent Office on Jan. 14, 2009 in connection with corresponding Australianpatent application No. 2005275639.

Letter from Australian Associate to Korean Associate enclosing Australian Search Report and including comments on the objections raised by the Examiner therein.

* cited by examiner

【Figure 1】
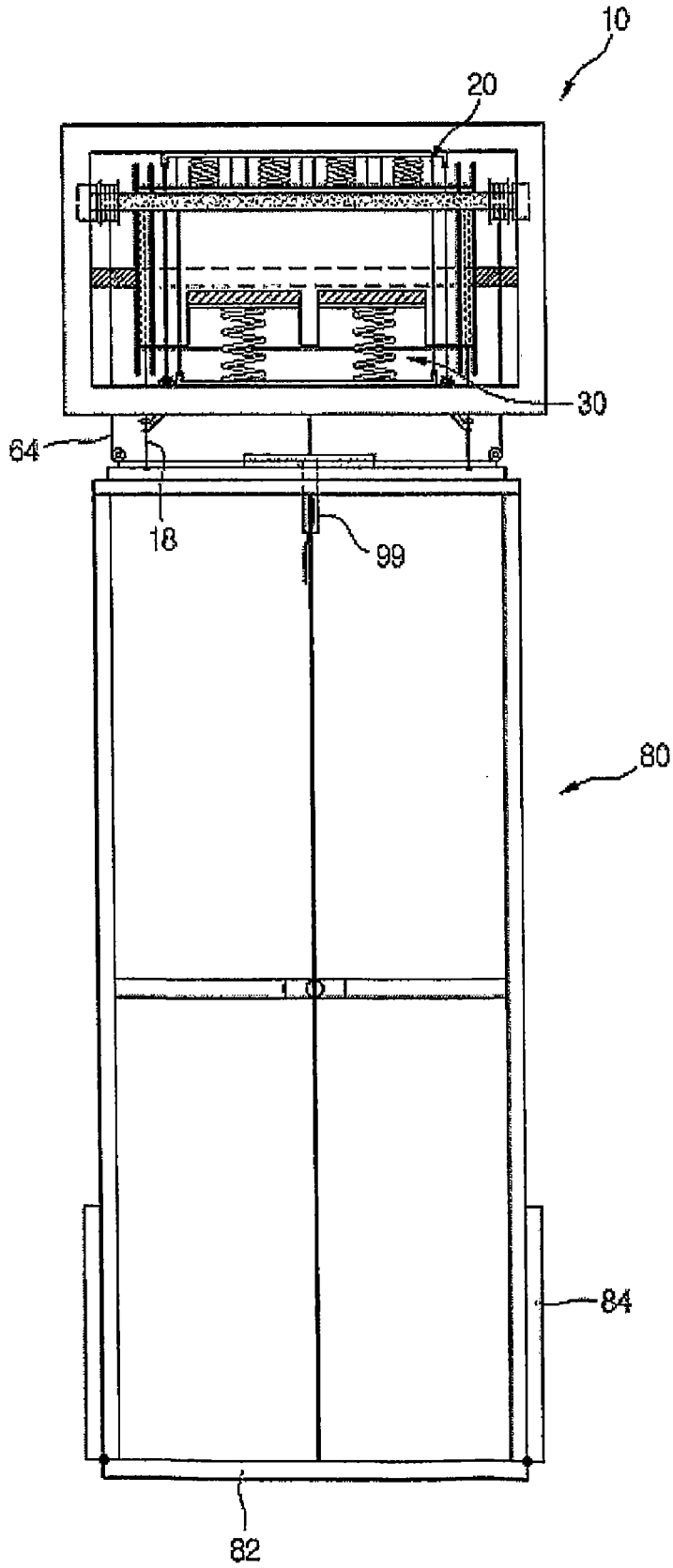

【Figure 2】
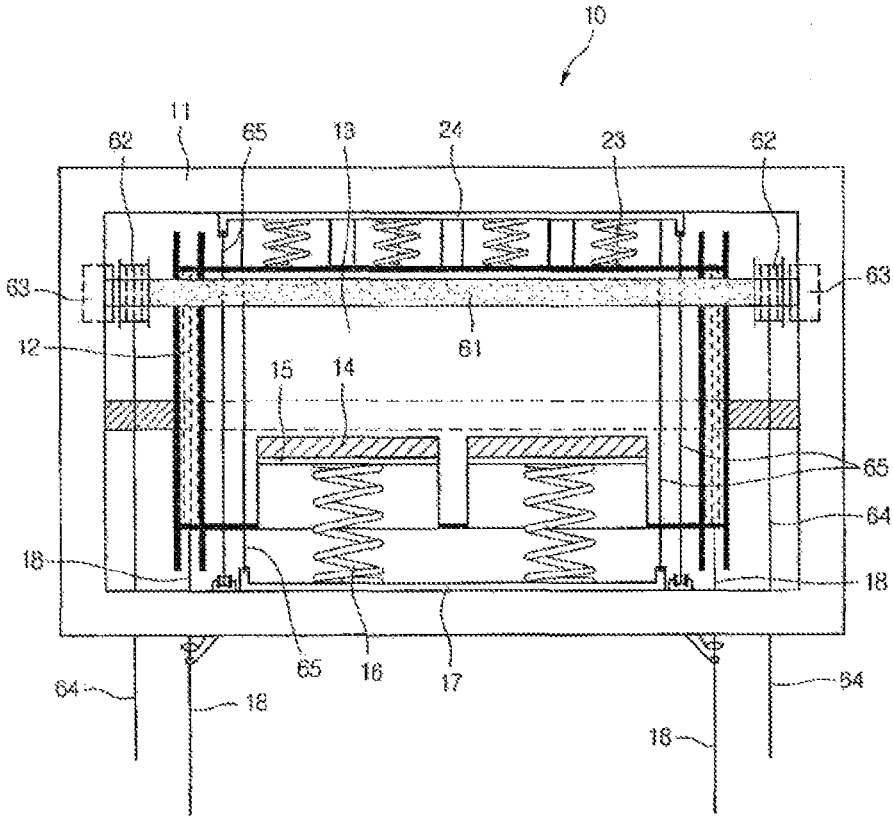

【Figure 3】
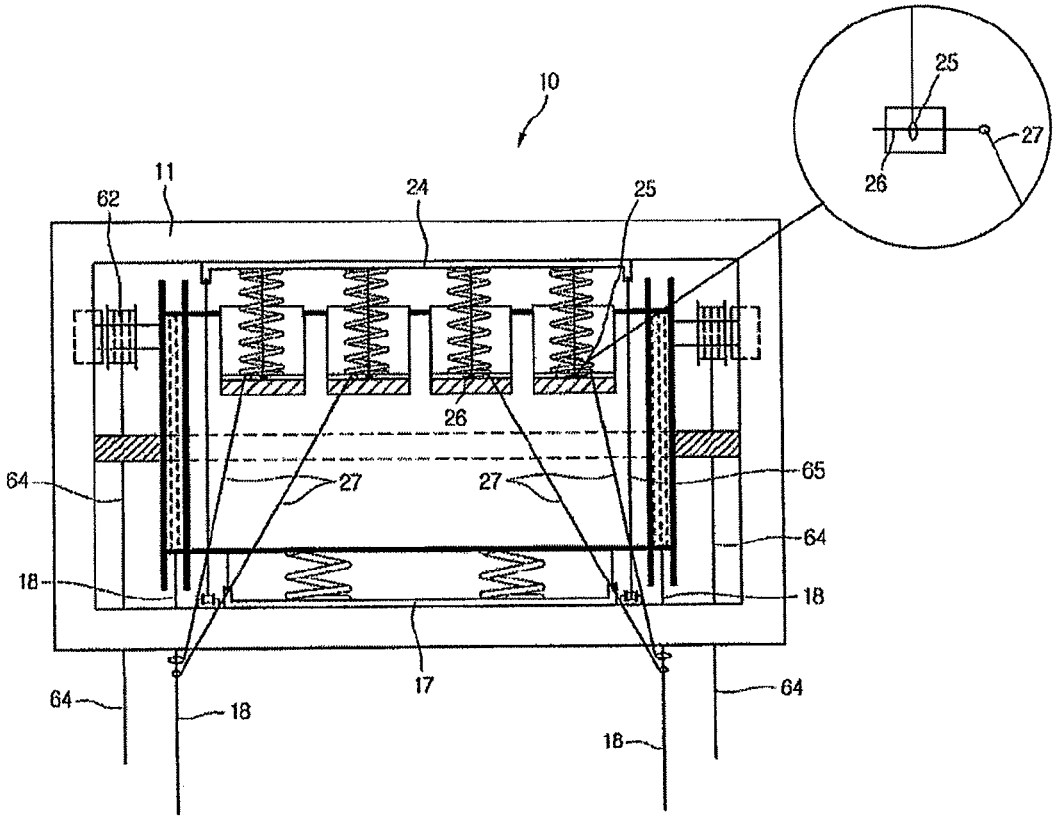

【Figure 4】
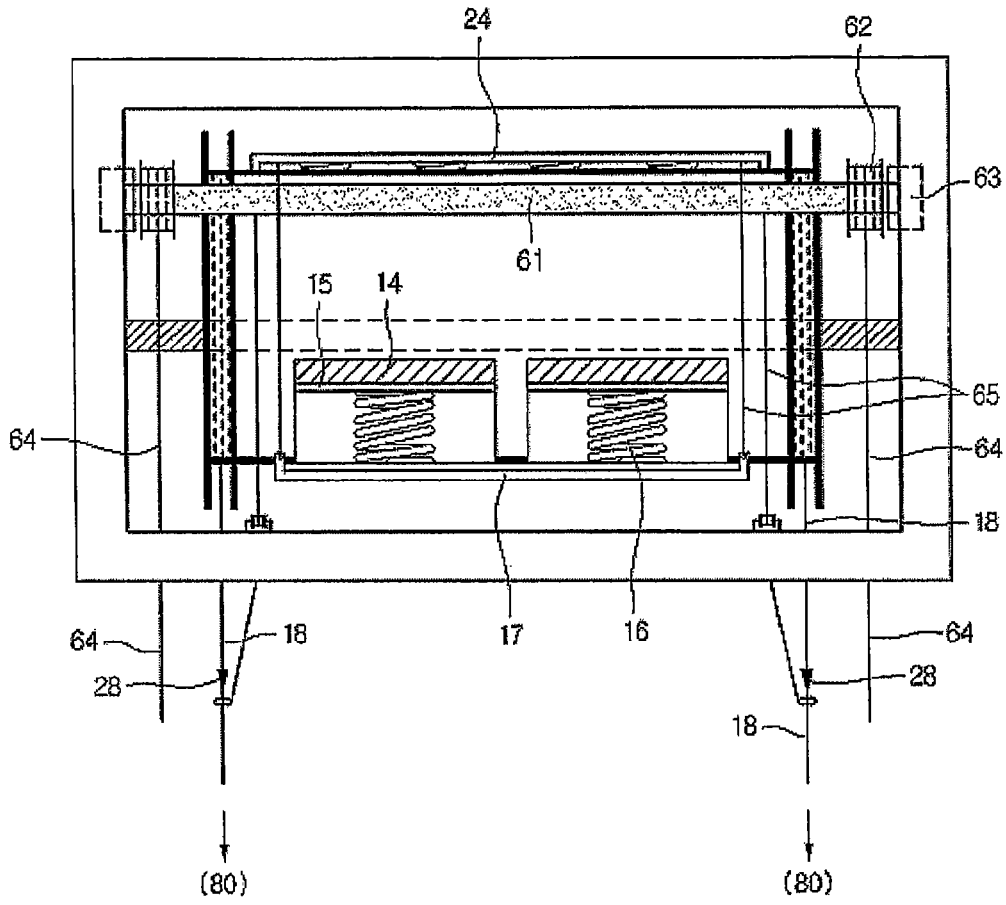

【Figure 5】
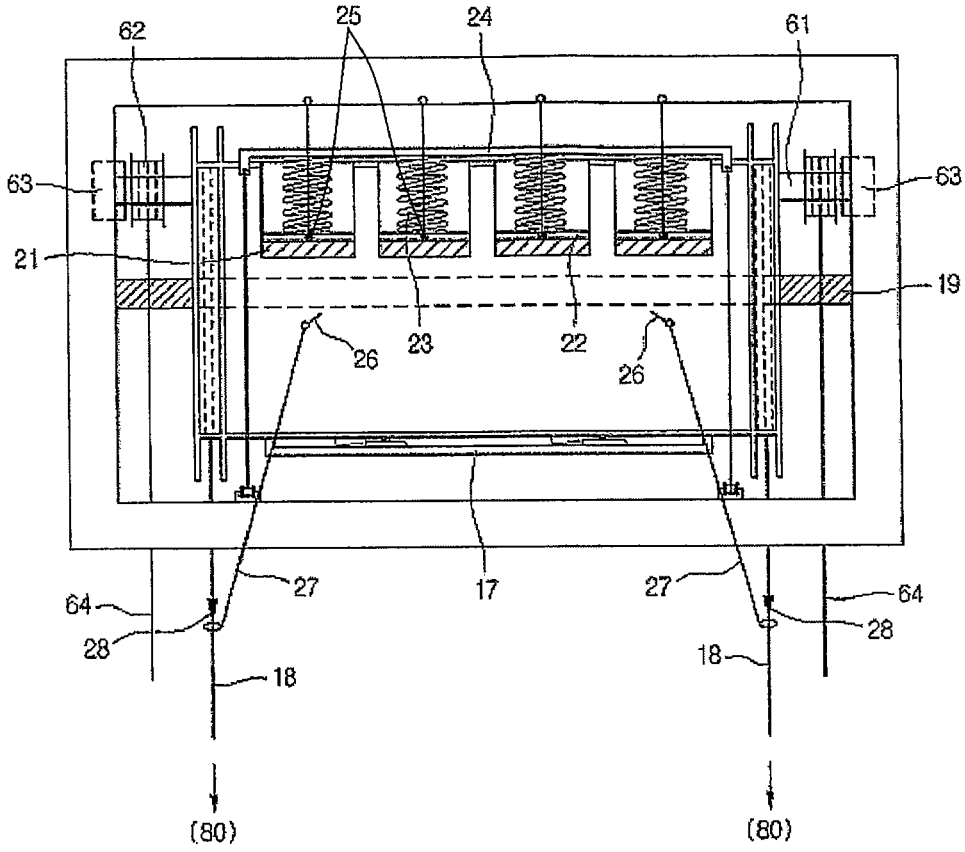

【Figure 6】
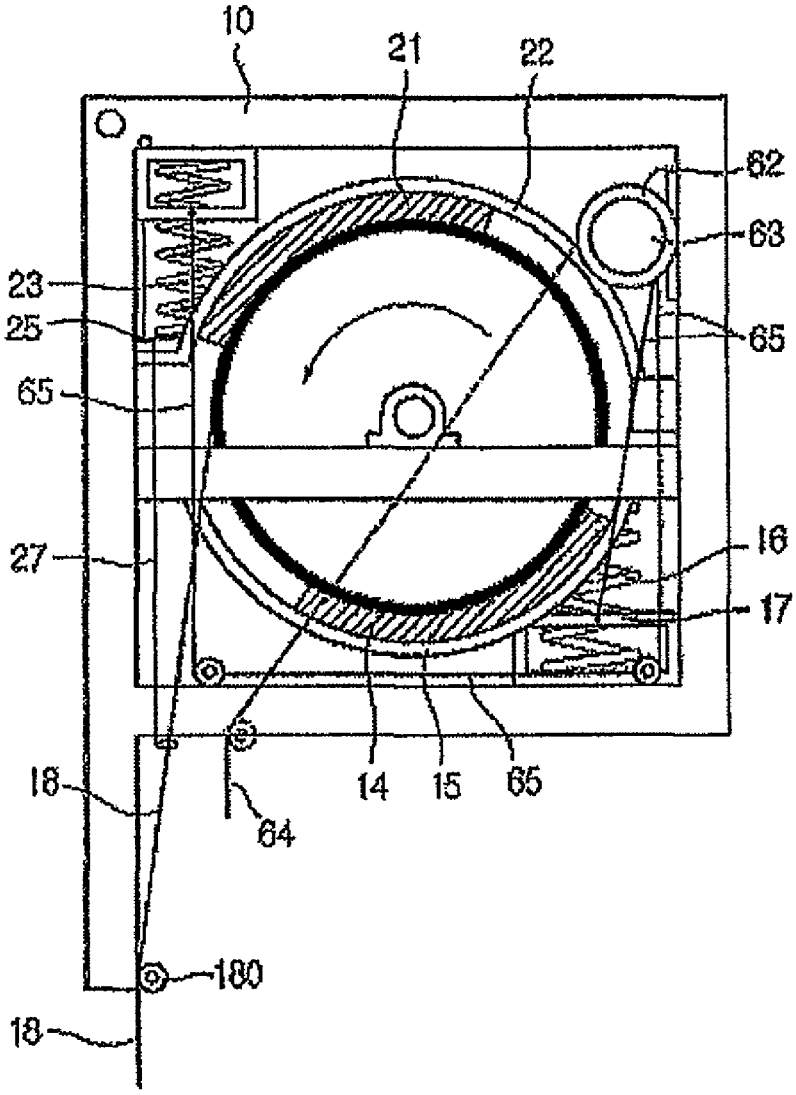

【Figure 7】
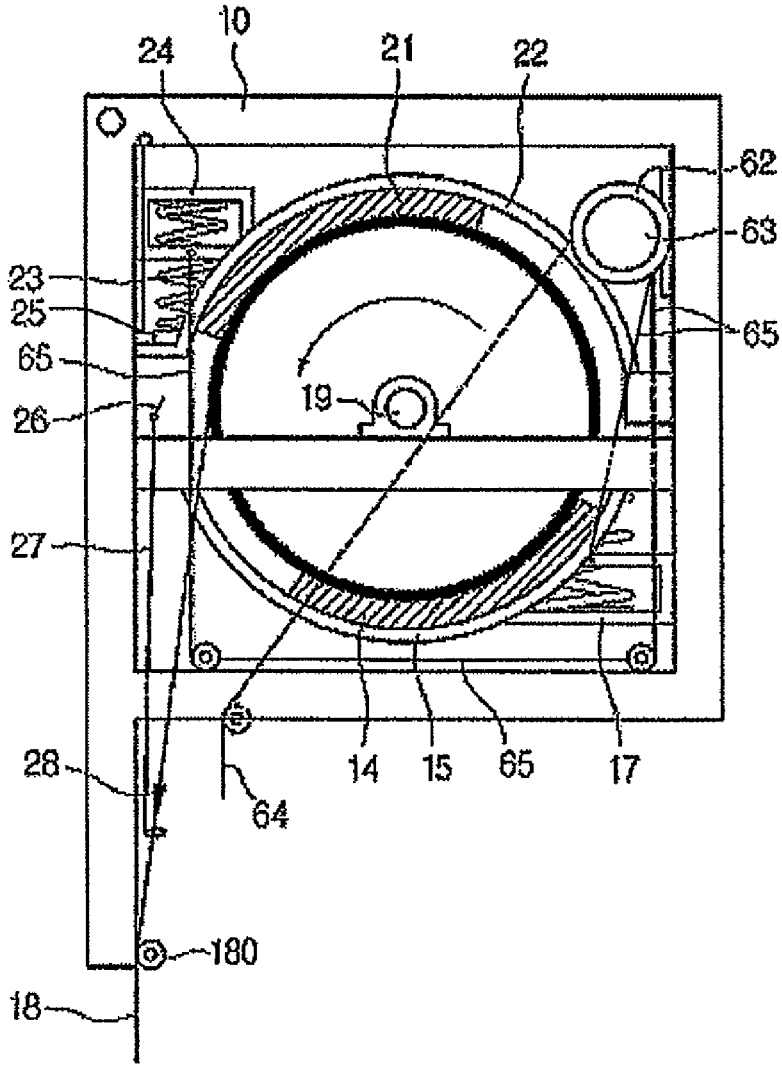

【Figure 8】
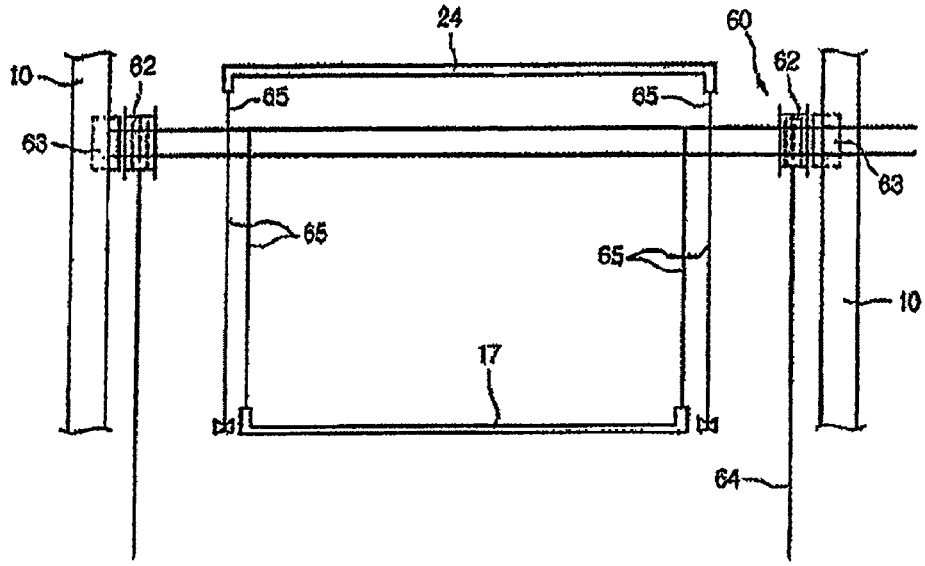
【Figure 9】
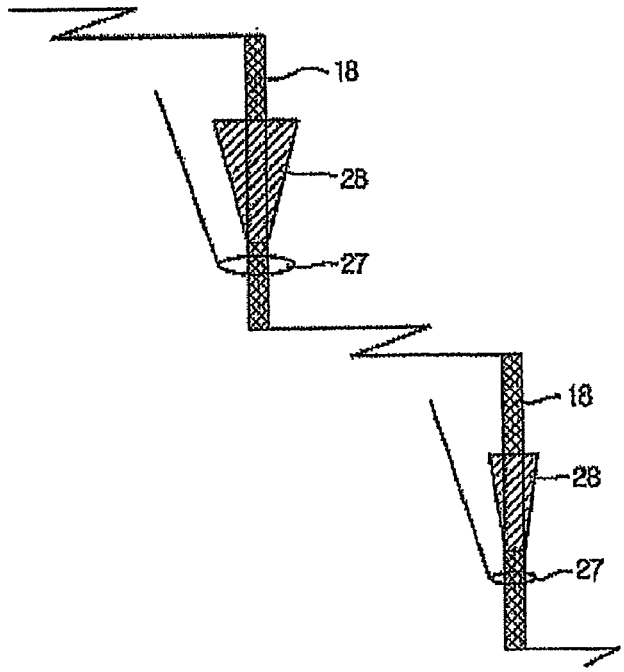

【Figure 10】
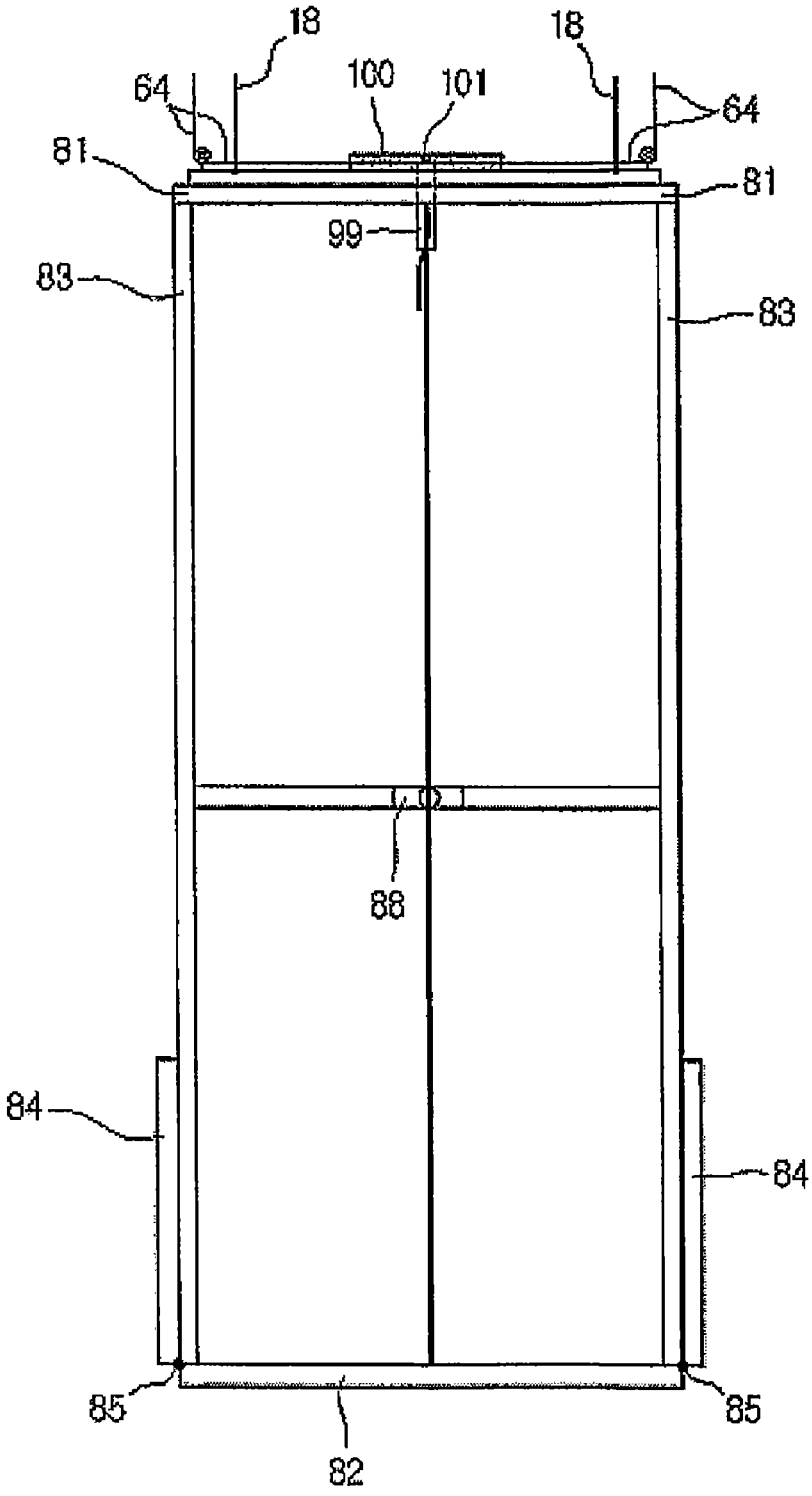

【Figure 11】
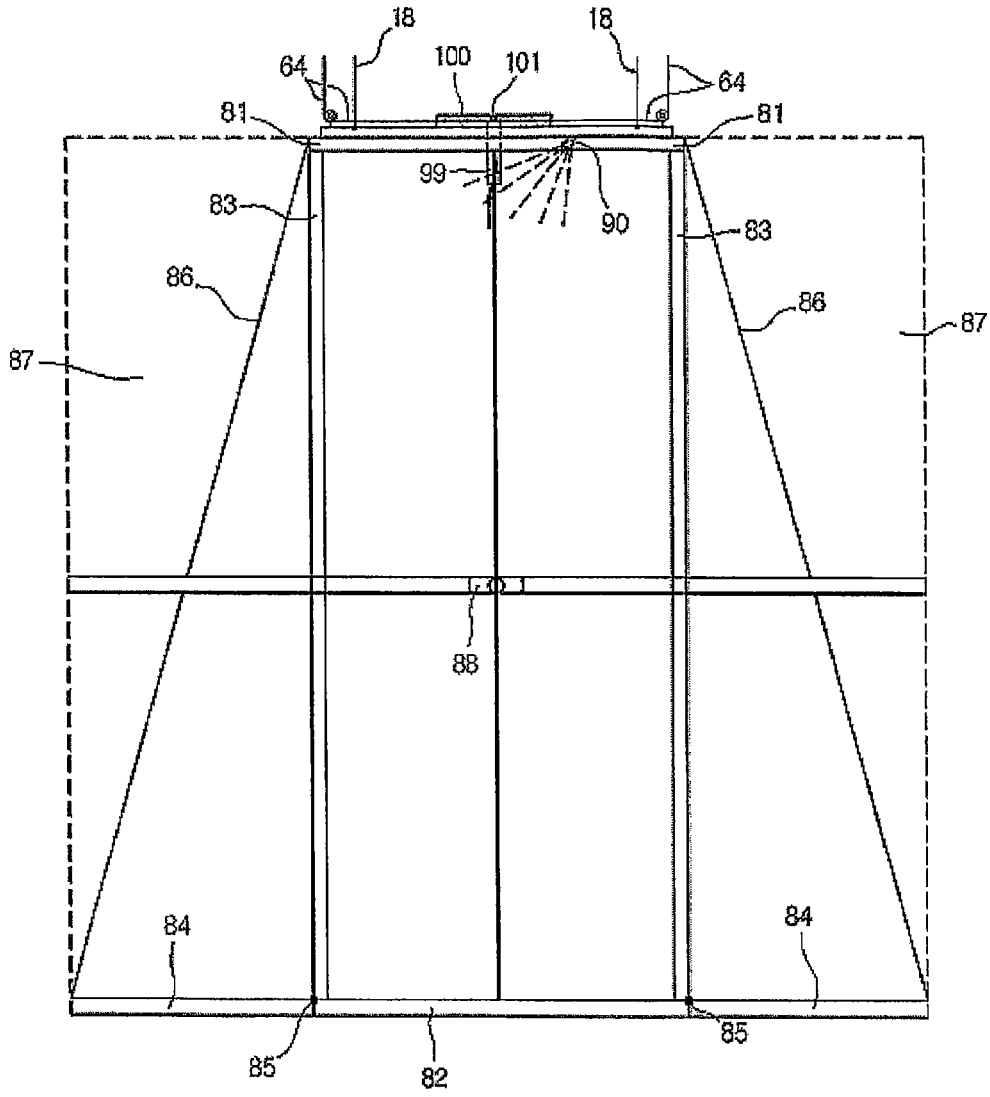

【Figure 12】
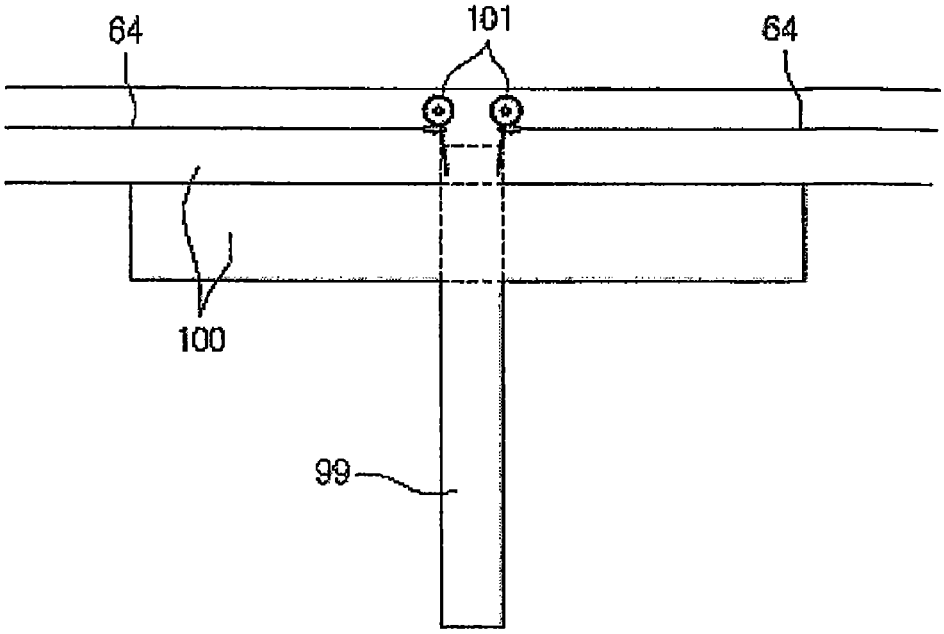
【Figure 13】
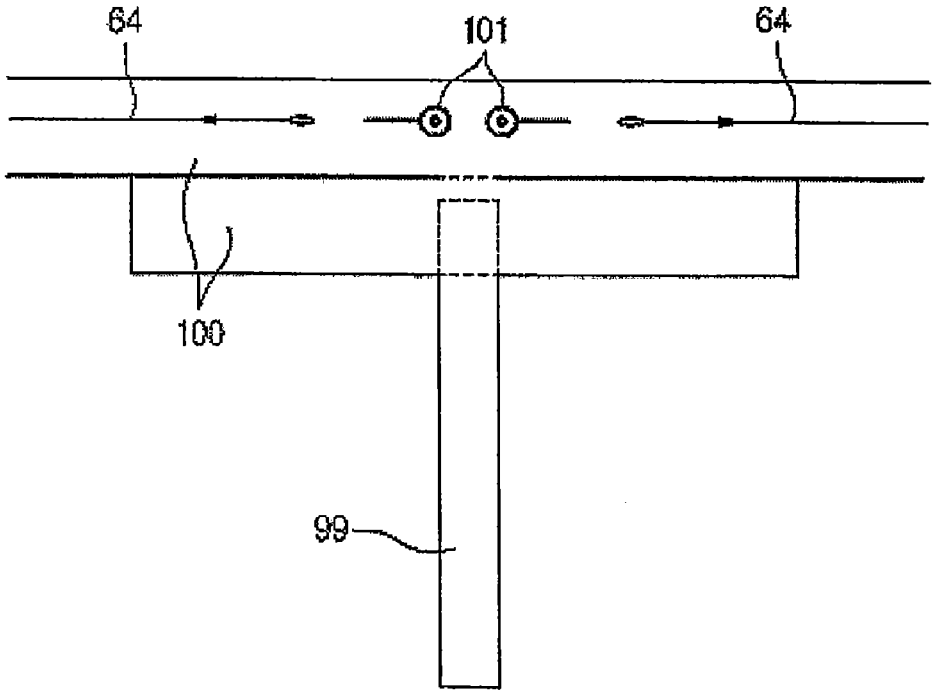

【Figure 14】
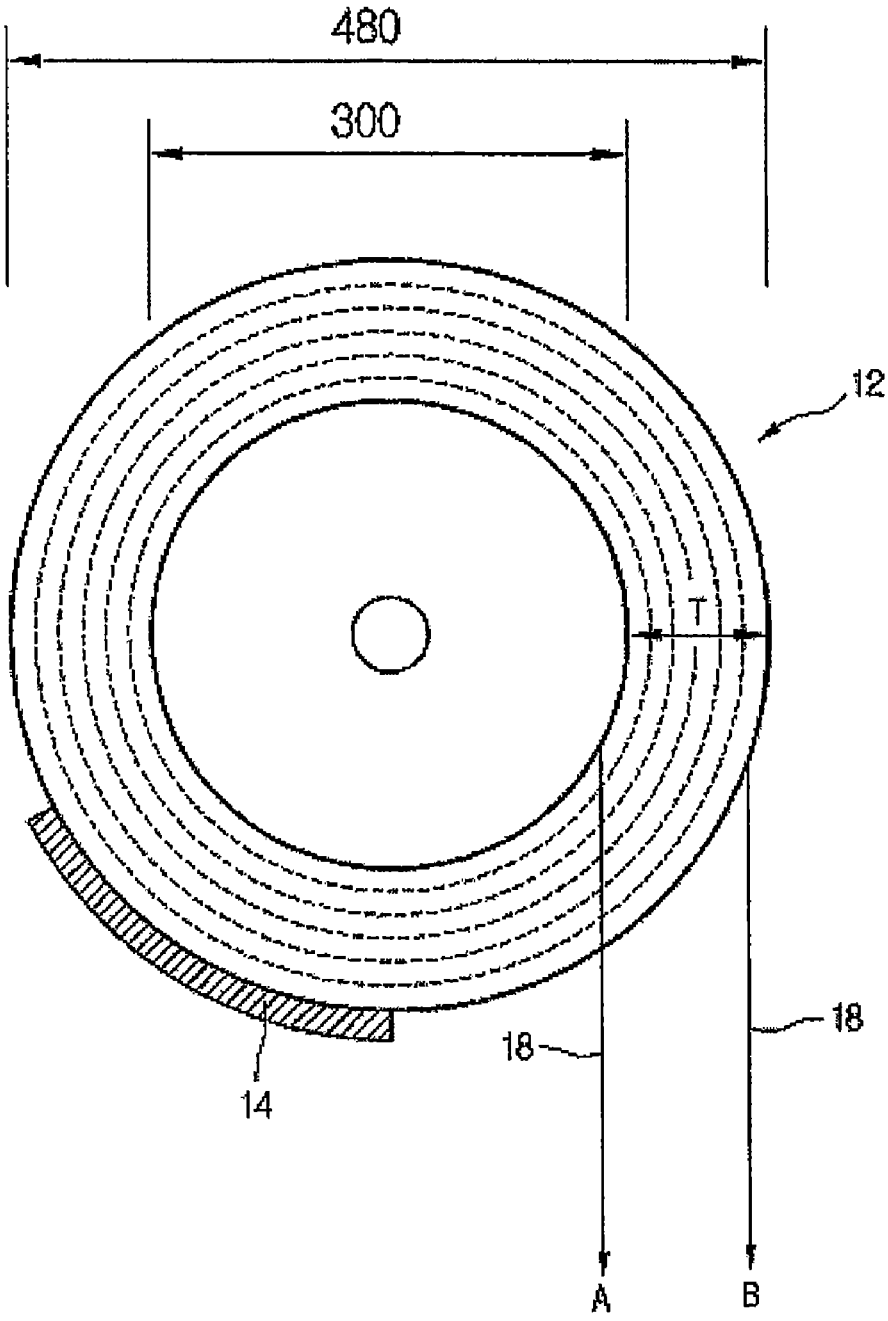

【Figure 15】
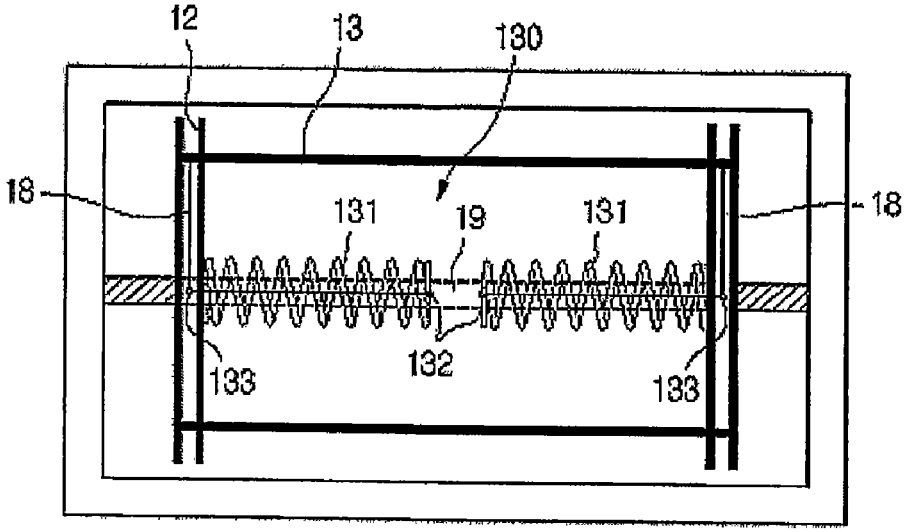
【Figure 16】
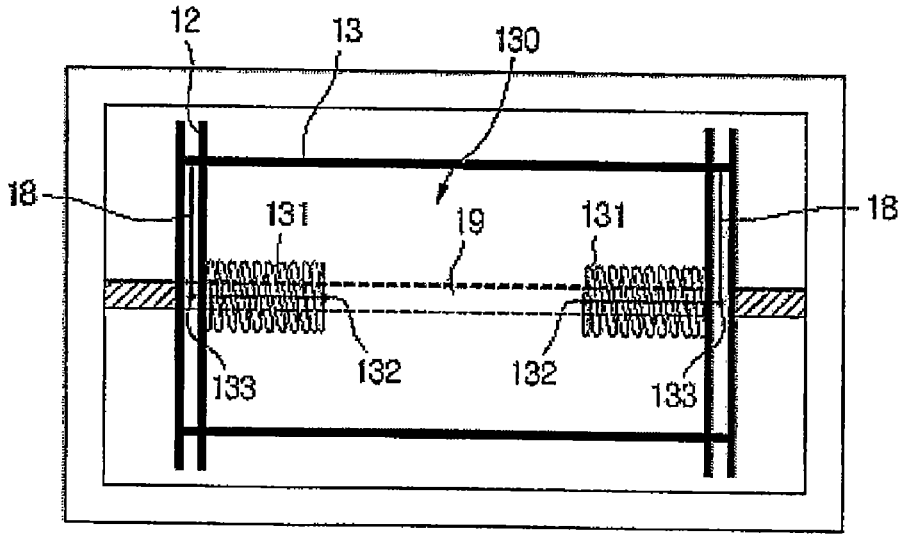

【Figure 17】
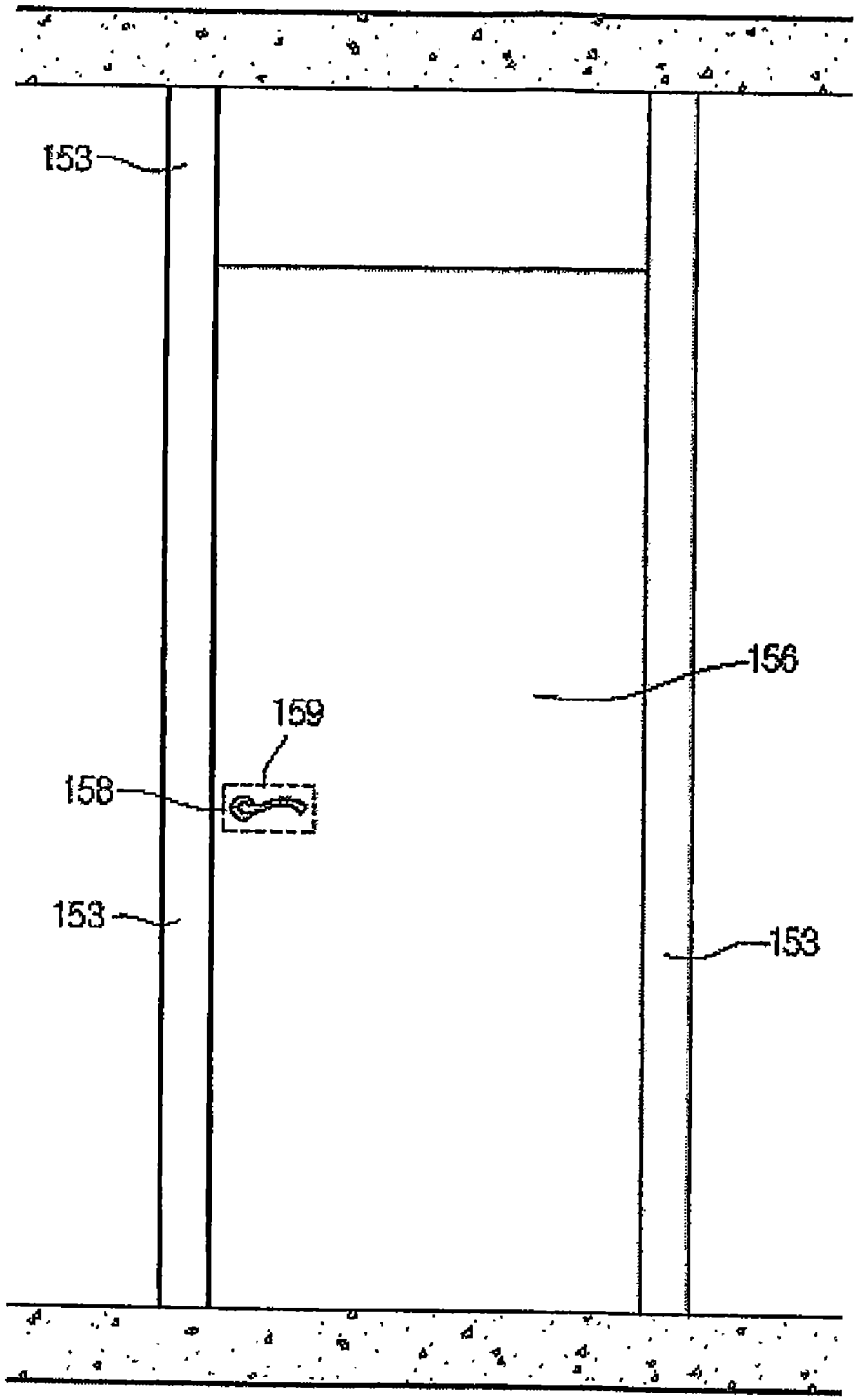

【Figure 18】
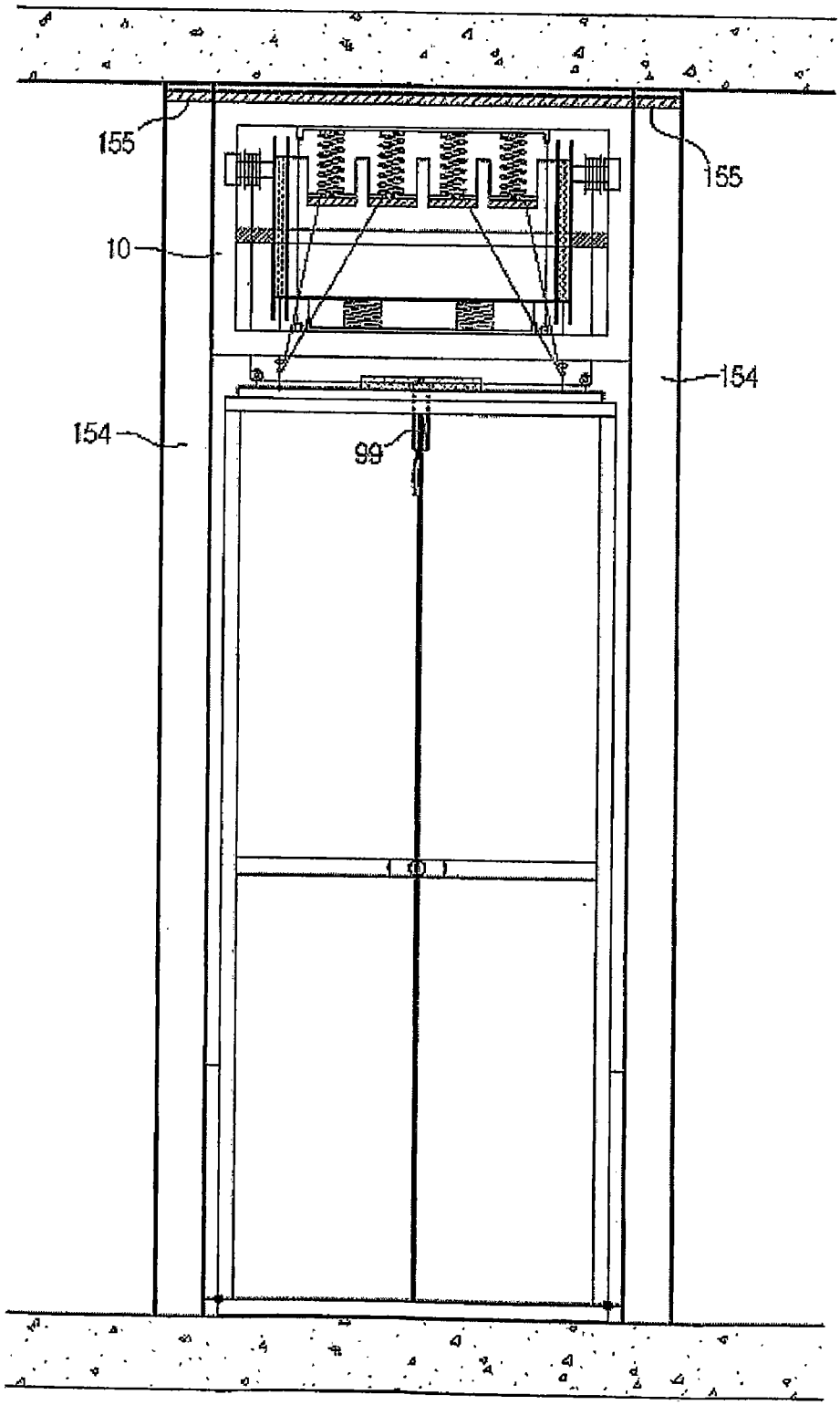

【Figure 19】
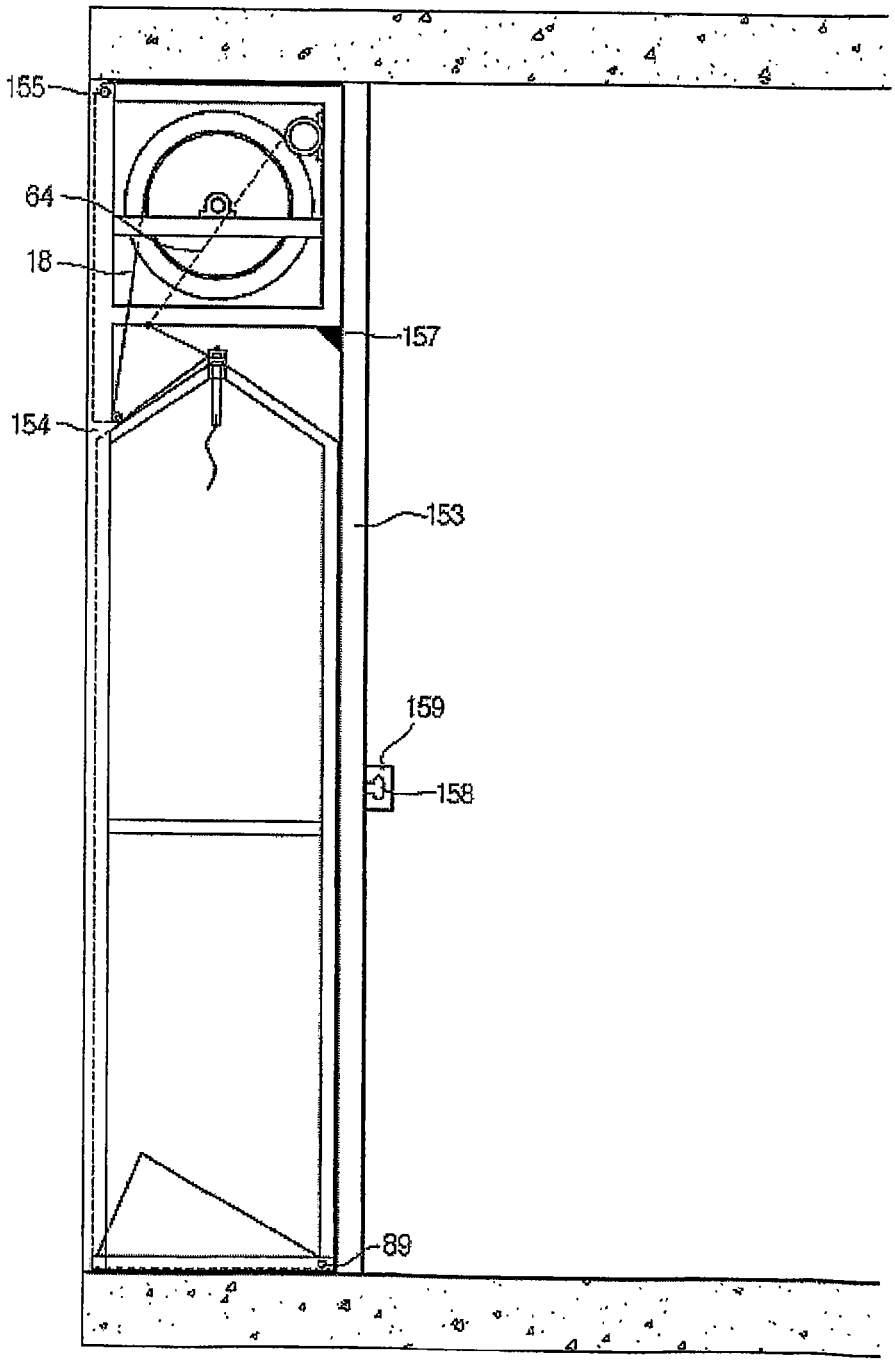

【Figure 20】
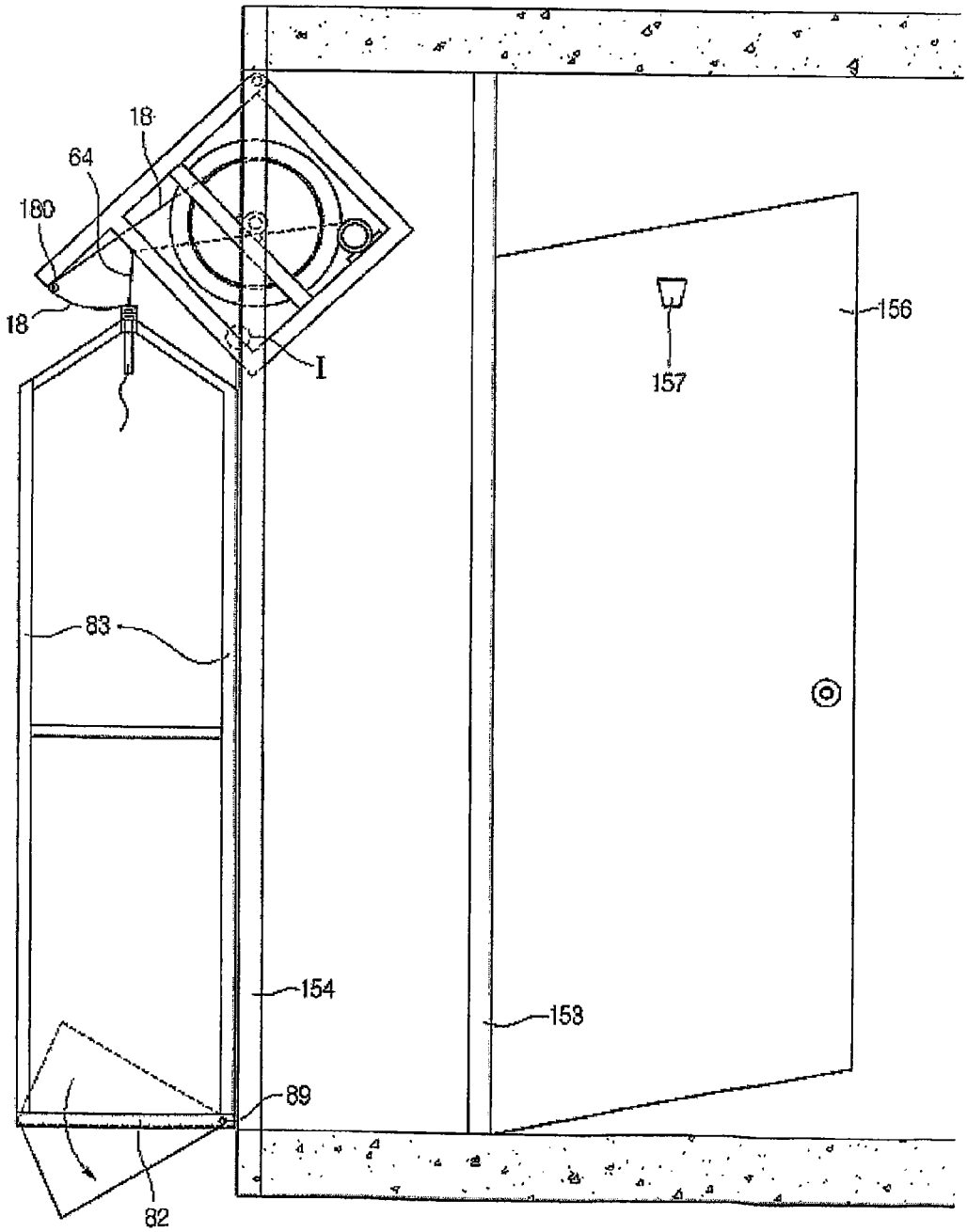

【Figure 21】
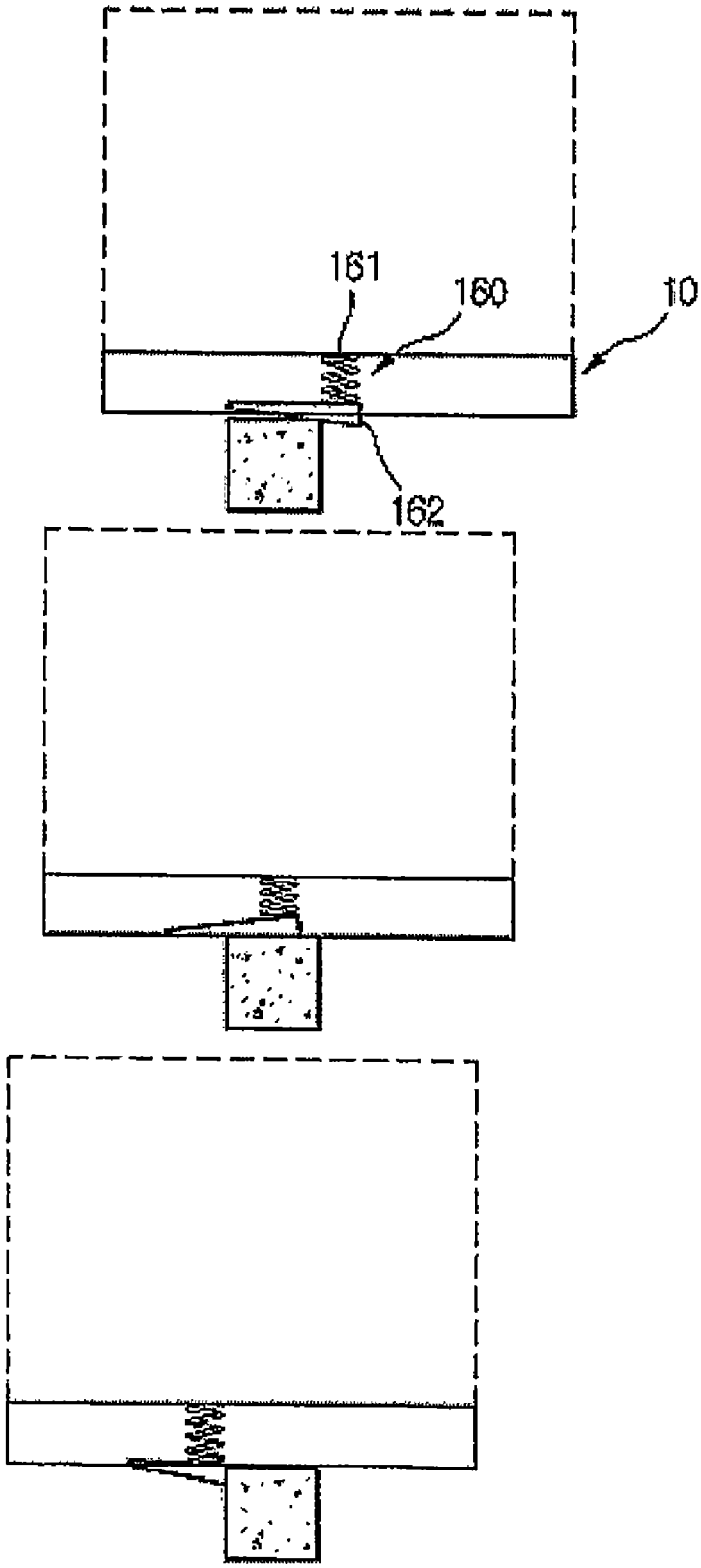

【Figure 22】
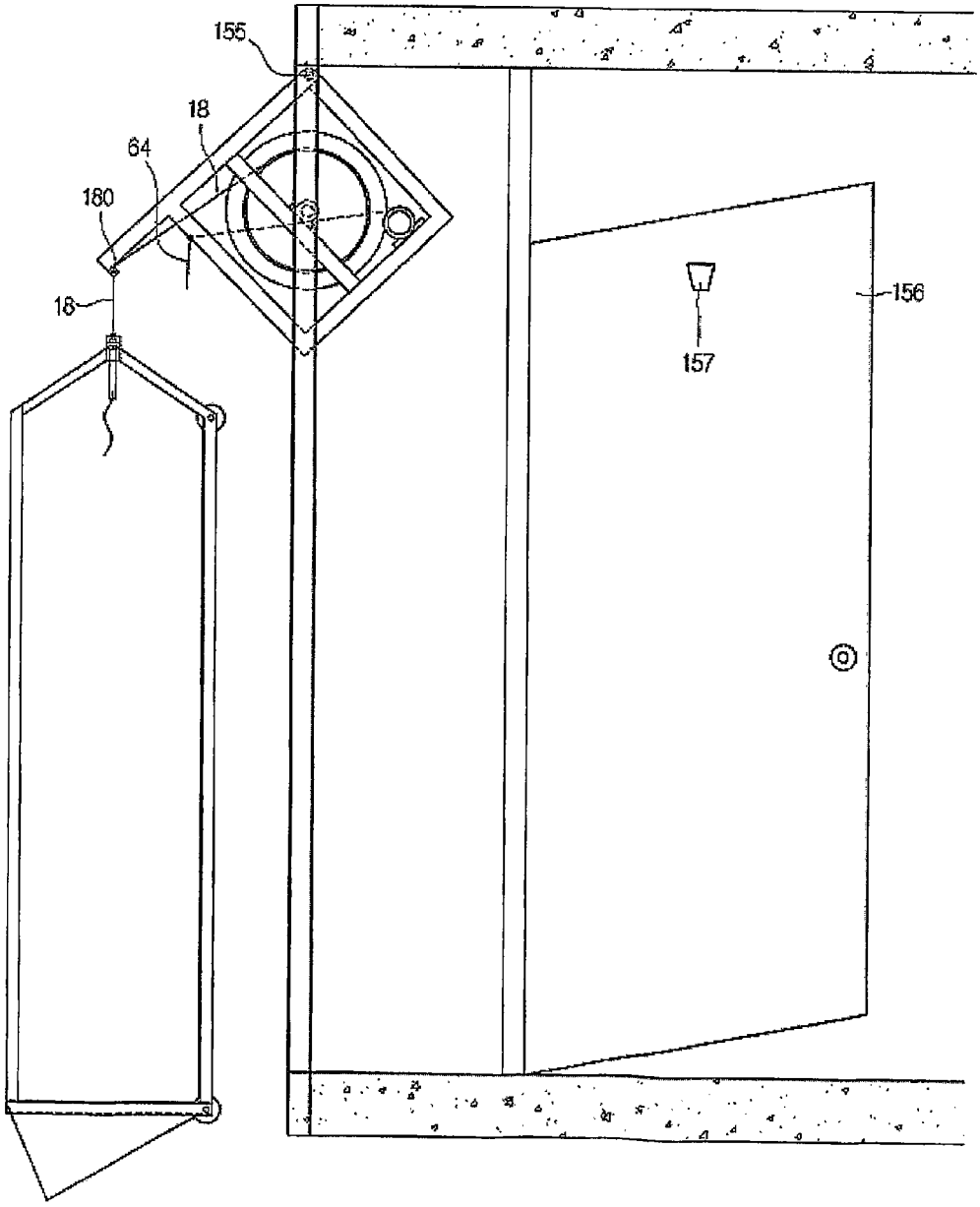

【Figure 23】
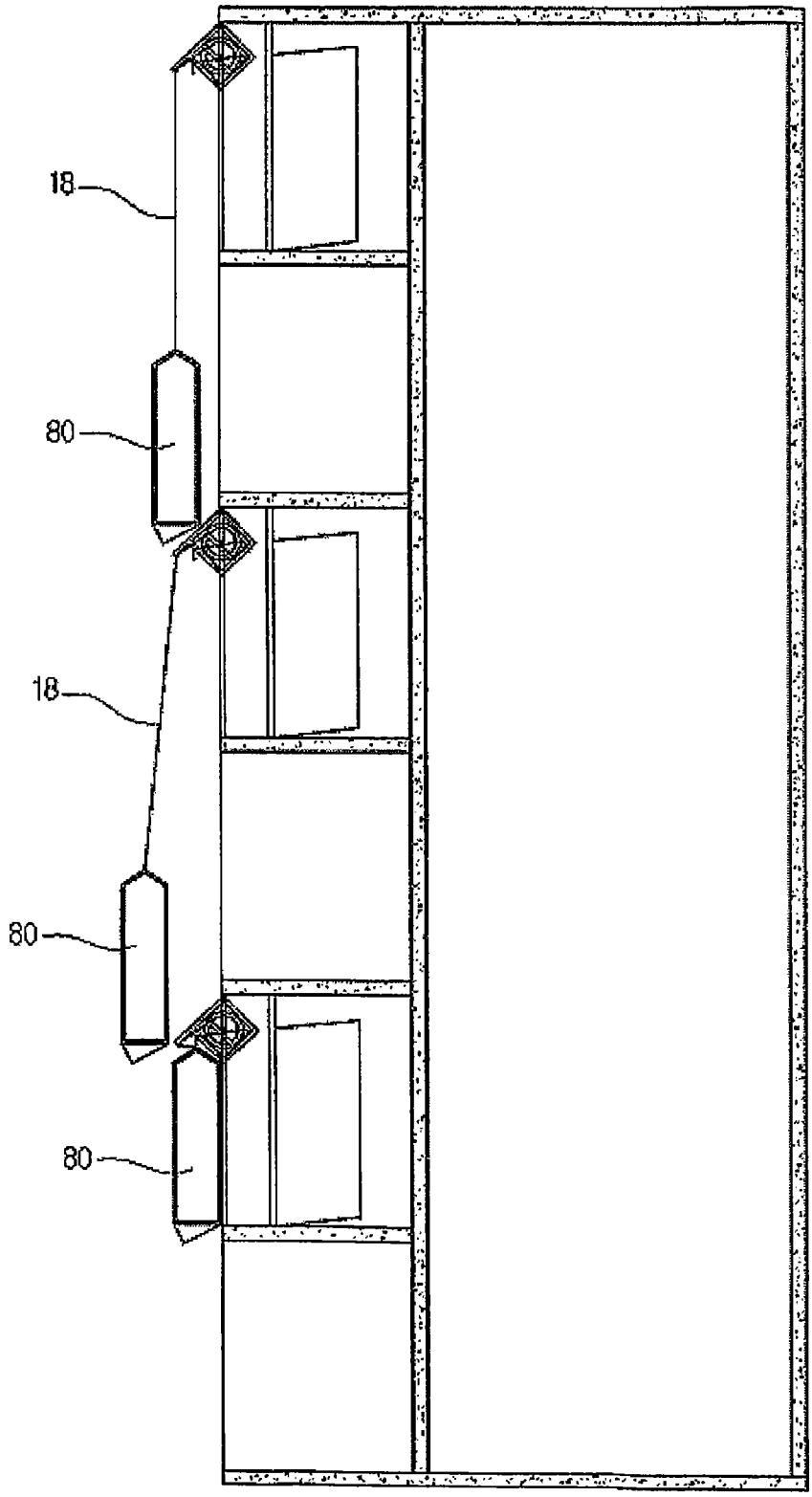

LIFE SAVING IMPLEMENT

CROSS REFERENCE TO RELATED APPLICATION

The present application is a 35 U.S.C. §371 national phase conversion of PCT/KR2005/002802 filed 25 Aug. 2005, which claims priority of Korean Patent Application No: 10-2004-0068186 filed 27 Aug. 2004, which are incorporated by reference herein in their entireties. The PCT International Application was published in the English Language.

TECHNICAL FIELD

The present invention relates to a life saving implement, and more particularly, to a mechanical elevator-type, non-power life saving implement, which can be used when a fire or an emergency breaks out in a high-rise building, a high-rise apartment, and the like and thus people intend to escape to the outdoor.

BACKGROUND ART

As the earth has grown in population, the skyscrapers have been built to effectively use the limited area of land. Therefore, when the fire breaks out in the skyscrapers, the interior furniture formed of flammable and toxic material and equipped in the skyscrapers may cause a disaster.

Furthermore, when the fire breaks out, the fire escape and hallway may function as a chimney that quickly sucks up the toxic gas and flame and the whole building becomes a sheet of flames.

In addition, when the fire breaks out, since the main/front door of the building cannot be used, people who are in the building have to escape out of the building through a window or a veranda. Therefore, people who cannot be rescued in advance may be victims by the flame and toxic gas or by leaping down from the building. In emergency situations such as the September 11 terrorist attack in the U.S., many peoples were victims while working down the narrow flights of the stairs.

Accordingly, descending life lines have been used in case the fire or other emergencys break out. That is, the people can escape out of the building through the window or veranda using the descending lifelines.

However, the conventional descending lifelines have a problem in that it cannot be used above a tenth floor. Furthermore, the descending life is designed to be used for one by one.

Furthermore, the conventional descending lifelines are complicated in use, having a limited function. Therefore, the frequency in use of the conventional descending life is very low even in an emergency.

In addition, since the conventional descending lifelines are designed to operate by an electric power, it may not work when the fire breaks. That is, when the fire breaks out in the building, the electric power line may be damaged not to supply the electric power to the descending lifelines.

DISCLOSURE

Technical Problem

Accordingly, the present invention is directed to a life saving implement, which substantially obviates one or more problems due to limitations and disadvantages of the related art.

It is an object of the present invention to provide a life saving implement that can work without power and carry several people at a time.

Technical Solution

To achieve these objects and other advantages and in accordance with the purpose of the invention, as embodied and broadly described herein, there is provided a life saving implement comprising: a prime motor assembly; a winding drum installing in the prime motor assembly to wind a wire rope; a braking drum installed on a side of the winding drum to control an RPM of the winding drum; a braking unit installed on a lower portion of the braking drum to control an RPM of the braking drum; a speed reduction unit installed on an upper portion of the braking drum to gradually reduce the RPM of the winding drum until the winding drum stops; and a passenger vehicle moving by the rotations of the winding drum and the braking drum.

According to another aspect of the present invention, there is provided a life saving implement comprising: a prime motor assembly; a passenger vehicle connected to the prime motor assembly by a wire rope; a winding drum around which the wire rope is wound and which is installed in the prime motor assembly; a braking unit for controlling an RPM of the winding drum that rotates as the wire rope is released; a braking drum installed on an upper portion of the braking unit and rotated together with the winding drum; a speed reduction unit for reducing the RPM of the winding drum when the passenger vehicle reaches a predetermined height from the ground; a pressure booster for increasing compressive forces of braking and speed reduction springs that are mounted in the braking unit and the speed reduction unit, respectively;, and a buffering unit for buffering the descent of the passenger vehicle.

According to still another aspect of the present invention, there is provided a life saving implement comprising: a prime motor assembly; a winding drum installed in the prime motor assembly to wind a wire rope; a braking drum installed on a side of the winding drum to control an RPM of the winding drum; a center rod coupled to an inner surface of the braking drum to function as a rotational shaft of the winding and braking drums; a braking unit installed on a lower portion of the braking drum to control an RPM of the braking drum; a speed reduction unit installed on an upper portion of the braking drum to gradually reduce the RPM of the winding drum until the winding drum stops; and a passenger vehicle moving by the rotations of the winding drum and the braking drum.

ADVANTAGEOUS EFFECTS

According to the present invention, people in an emergency can quickly escape out of a building using the inventive life saving implement regardless of the height of the building.

In addition, since the inventive life saving implement is designed to operate without using power, it can work even when the fire breaks out to damage the electric power line.

Furthermore, since the implement descends at a safe speed in response to the load of the people loaded in the implement, the people can safely escape out of the building.

DESCRIPTION OF DRAWINGS

The accompanying drawings, which are included to provided a further understanding of the invention and are incorporated in and constitute a part of this application, illustrate embodiment of the invention and together with the description serve to explain the principle of the invention. In the drawings:

FIG. 1 is a schematic sectional view of a life saving implement according to an embodiment of the present invention;

FIG. 2 is a sectional view illustrating a front portion of a prime motor assembly depicted in FIG. 1 before a life saving implement of the present invention is operated;

FIG. 3 is a sectional view illustrating a rear portion of a prime motor assembly depicted in FIG. 1 before a life saving implement of the present invention is operated;

FIG. 4 is a sectional view illustrating a front portion of a prime motor assembly depicted in FIG. 1 after a life saving implement of the present invention is operated;

FIG. 5 is a sectional view illustrating a rear portion of a prime motor assembly depicted in FIG. 1 after a life saving implement of the present invention is operated;

FIG. 6 is a sectional view illustrating a side portion of a prime motor assembly depicted in FIG. 1 before a life saving implement of the present invention is operated;

FIG. 7 is a sectional view illustrating a side portion of a prime motor assembly depicted in FIG. 1 after a life saving implement of the present invention is operated;

FIG. 8 is a view of a pressure booster depicted in FIG. 1;

FIG. 9 is a view of a wire rope and a wire ring that are depicted in FIG. 1;

FIG. 10 is a view of a passenger vehicle before a life saving implement of the present invention is operated;

FIG. 11 is a view of a passenger vehicle after a life saving implement of the present invention is operated;

FIG. 12 is a view illustrating a wire rope of a wire rope separator installed on an upper portion of a passenger vehicle before the wire rope is separated from the wire rope separator FIG. 13 is a view illustrating a state where a wire rope of a wire rope separator installed on an upper portion of a passenger vehicle is being separated from the wire rope separator;

FIG. 14 is a view illustrating a wire rope wound around a winding drum;

FIG. 15 is a sectional view of a buffering device before a life saving implement of the present invention is operated;

FIG. 16 is a sectional view of a buffering device after a fife saving implement of the present invention is operated;

FIG. 17 is a front view of a life saving implement of the present invention that is installed in a building;

FIG. 18 is a rear view of a life saving implement of the present invention that is installed in a building;

FIG. 19 is a side view of a life saving implement of the present invention that is installed in a building;

FIG. 20 is a side view illustrating a state where a passenger vehicle and a prime motor assembly are installed on an outer side of a building;

FIG. 21 is a detailed view of a portion I of FIG. 20;

FIG. 22 is a side view illustrating a state where a passenger vehicle is descending by the operation of a life saving implement of the present invention; and FIG. 23 is a view illustrating an example where life saving implements of the present invention are simultaneously used in many stories.

BEST MODE

Reference will now be made in detail to the preferred embodiment of the present invention, examples of which are illustrated in the accompanying drawings. Wherever possible, the same reference numbers will be used throughout the drawings to refer to the same or like parts.

FIG. 1 shows a life saving implement according to an embodiment of the present invention.

Referring to FIG. 1, the inventive life saving implement includes a passenger vehicle 80 for loading evacuees, a prime motor assembly 10 for descending the passenger vehicle 80 at a safe speed, a first wire rope 18 wound in the prime motor assembly 10 and connected to a top of the passenger vehicle 80.

For the descriptive convenience, the evacuees will be referred as passengers getting on the passenger vehicle 80.

When the first rope 18 wound in the prime motor assembly 10 is released, the passenger vehicle 80 descends. The prime motor assembly 10 includes a braking unit 30 and a speed reduction unit 20 that are used to control the descending speed of the passenger vehicle 80.

The passenger vehicle 80 includes a bottom plate 82 supporting the passengers and sub-plates 84 erected on edges of the bottom plate 82. The sub-plates 84 are designed to pivot around the edges of the bottom plate 82 by hinge shafts.

A start handle 99 is mounted on a sealing of the passenger vehicle 80 so that the passenger can control a wire rope separator 100 to allow the passenger vehicle to descend.

A second wire rope 64 is connected to the prime motor assembly 10 and removably connected to the passenger vehicle 80.

The operation of the above-described life saving implement will be now described. First, when the fire breaks out, the passengers get on the passenger vehicle 80 and pull down the start handle 99. Then, the second wire rope 64 is separated from the rope separator 100.

The prime motor assembly 10 operates to release the first wire rope 18 wound around a drum (not shown), thereby descending the passenger vehicle 80.

In order to control the release speed of the first wire rope 18, i.e., the descending speed of the passenger vehicle 80, the braking unit 30 and the speed reduction unit 20 operates. That is, the release speed of the first wire rope 18 is reduced by the operation of the braking unit 30. When the passenger vehicle 80 reaches a predetermined height from the ground, the speed reduction unit 20 operates to gently stop the passenger vehicle 80.

FIG. 2 is a sectional view illustrating a front portion of a prime motor assembly depicted in FIG. 1 before a life saving implement of the present invention is operated and FIG. 3 is a sectional view illustrating a rear portion of a prime motor assembly depicted in FIG. 1 before a life saving implement of the present invention is operated.

Referring to FIGS. 2 and 3, the prime motor assembly 10 includes a motor body 11, a braking drum 13 rotatably installed in the motor body 11, winding drums 12, which are installed on opposite sides of the braking drum 13 and on which the first wire rope 18 are wound by a plurality of turns, a central shaft 19 functioning as a rotational shaft of the braking drum 13, a brake lining 14 controlling the rotation of the braking drum 13, a braking connection plate 15 mounted on a lower portion of the brake lining 14 to prevent the brake lining 14 from being removed, an irregular pitch spring 16 mounted on a lower connecting plate 15 of the brake lining 14 to bias the brake lining 14, and a brake frame 17 mounted on a lower portion of the irregular pitch spring 16 to generate compressive force of the irregular pitch spring.

The prime motor assembly 10 further includes a speed reduction lining 21 contacting an upper portion of the braking drum 13 to control an RPM of the braking drum 13 and a speed reduction connecting plate 22 mounted on a top surface of the speed reduction lining 21 to reinforce the speed reduction lining 21 and prevent the speed reduction lining 21 from being removed as the braking drum 13 rotates.

The prime motor assembly 10 further includes an irregular pitch spring 23 mounted on an upper portion of the speed reduction connecting plate 22 to apply compressive force and a speed reduction braking frame 24 mounted on an upper portion of the irregular pitch spring 23 to generate the compressive force of the irregular pitch spring 23.

The prime motor assembly 10 further includes a hook ring 25 for allowing the speed reduction lining 21 to be spaced away from the braking drum 13 when the speed reduction unit 20 is not operated and a pin 26 allowing the braking drum 13 to contact or move away from the upper portion of the braking drum 13 by being inserted in or removed from the hook ring 25. A fifth wire rope 27 is connected to an end of the pin 26 so that the user pulls the fifth wire rope 27 to remove the pin 26 from the hook ring 25. A plurality of fourth wire ropes are configured to hang the plurality of speed reduction linings 21 from the motor body, and have hook rings 25 connected to speed reduction linings.

A pressure booster drum 62 is mounted on the braking drum 13 and a one-way bearing 63 is spaced away from the pressure booster drum 62.

That is, the pressure booster drum 62 and the one-way bearing 63 are coupled to each other by a supporting rod inserted The one-way bearing 63 controls the supporting rod 61 such that the supporting rod 61 rotates in only one direction.

The second wire rope 64 has a first end fixed on the pressure booster drum 62 and a second end inserted in a ring and coupled to the rope separator 100 mounted on an upper portion of the passenger vehicle 80.

There is further provided a third wire rope 65 having a first end connected to the supporting rod 61 and a second end connected to the braking frame 17 and the speed reduction braking frame 24.

FIG. 4 is a sectional view illustrating a front portion of a prime motor assembly depicted in FIG. 1 after a life saving implement of the present invention is operated, FIG. 5 is a sectional view illustrating a rear portion of a prime motor assembly depicted in FIG. 1 after a life saving implement of the present invention is operated, FIG. 6 is a sectional view illustrating a side portion of a prime motor assembly depicted in FIG. 1 before a life saving implement of the present invention is operated, and FIG. 7 is a sectional view illustrating a side portion of a prime motor assembly depicted in FIG. 1 after a life saving implement of the present invention is operated.

Referring to FIGS. 4 through 7, in the operation of the life saving implement of the present invention, the passenger vehicle 80 descends while the first rope wound around the winding drum 12 is released.

That is, when the braking drum 13 mounted in the winding drum 12 rotates, the braking unit 30 and the speed reduction unit 20 that respectively are mounted on the lower and upper portions of the braking drum 13 are operated. As the braking drum 13 and the speed reduction unit 20 operate, the RPM of the braking drum 13 is reduced and the descending speed of the passenger vehicle is gradually reduced until it stops.

The braking unit 30 is designed to control the release of the first wire rope 18 wound around the winding drum 12 such that the first wire rope 18 can be released at a safe speed. The pressure booster 60 is designed to control the compressive force of the irregular pitch springs 16 and 23 mounted on the braking unit 30 and the speed reduction unit 20 such that the braking force and the speed reduction force that are respectively generated by the braking unit 30 and the speed reduction unit 20 can be controlled to be proper to the load applied by the passengers.

The braking and speed reduction units 30 and 20 are designed using a theory where a deformation of a solid material is proportional to applied force as far as the applied force is over predetermined force. That is, a spring extends with the weight of a weight. This theory is applied in designing the braking and speed reduction units 30 and 20 of the present invention.

Therefore, when the passengers gets on the passenger vehicle 80, the braking irregular pitch spring 16 is applied with pressure higher than a load applied by the passengers by the pressure booster drum 62 and the one-way bearing 63.

In addition, the first wire rope 18 is released with a speed proper to braking force of the braking unit 30, thereby descending the passenger vehicle at a safe speed.

In the operation of the speed reduction unit 20, when the hook rings 25 are hooked on the fifth wire rope 27 one by one, the pins 26 are removed one by one and the reduction linings 21 contacts on the upper portion of the braking drum 13 in order, thereby stopping the braking drum 13 while gradually reducing the RPM of the braking drum 13. The compressive force of the irregular springs 16 and 23 is generated to be greater than the load applied by the passengers in the passenger vehicle 80 so that the braking drum 13 rotates at a speed proper to the load.

FIG. 8 illustrates the pressure booster 60 of the present invention.

Referring to FIG. 8, the pressure booster 60 includes the supporting rod 61 connected to a motor body 11, the pressure booster drum 62, which is mounted on both sides of the supporting rod 61 and on which the second wire rope 64 is wound, and the one-way bearing 63 spaced away from the pressure booster drum 62.

The one-way bearing 63 includes an inner case fixed on the supporting rod 61 and an outer case fixed on an inner surface of the motor body 11.

The second wire rope 64 is wound around the pressure booster drum 62. That is, the second wire rope 64 has a first end fixed on the pressure booster drum 62 and a second end coupled to the wire rope separator mounted on the upper portion of the passenger vehicle 80.

There are provided four third wire ropes 65 fixed on the supporting rod 61. That is, each of the third wire ropes 65 has a first end fixed to the supporting rod 61. second ends of two wire ropes 65 are connected to the braking frame 17 and second ends of remaining wire ropes 65 are connected to both sides of the speed reduction frame 24.

The operation of the pressure booster unit 60 will be described hereinafter.

When the emergency such as a fire occurs in a high-rise building and the persons gets on the passenger vehicle 80, the second wire rope 64 is to be pulled down by the load applied by the passengers.

When the second wire rope 64 is pulled down, the second wire rope 64 wound around the pressure booster drum 62 is released to rotate the pressure booster drum 62.

In addition, by the rotation of the pressure booster drum 62, the supporting rod 61 rotates so that the third wire rope 65 is wound around thereof. As a result, the braking frame 17 and the speed reduction frame 24 are to be displaced.

That is, the braking frame 17 moves upward while the speed reduction frame 24 moves downward. The compressive forces of the braking and speed reduction irregular pitch springs 16 and 23 are to be increased to be higher than the load applied by the passengers.

FIG. 9 illustrates the wire rope and the wire loop.

The wire rope 18 is provided with a knot defining a hook step.

The fifth wire rope 27 is connected to a pin 26 vertically moving the speed reduction lining 21 at an upper portion of the braking drum 13.

When the prime motor assembly 10 operates after the persons gets on the passenger vehicle 80, the wire loop 27 is pulled by being hooked on the knot 28 of the wire rope 18.

When the wire loop 27 is pulled, the pin 26 is removed from the hook ring 25 and the speed reduction lining 21 contacts the braking drum 13. Therefore, by the frictional force between the speed reduction lining 21 and the braking drum 13, the braking drum 13 is gradually reduced in its RPM until it stops.

As described above, by the structure for reducing the release speed of the wire rope, the life saving implement can be operated without using power.

FIG. 10 is a view of the passenger vehicle before the life saving implement of the present invention is operated, FIG. 11 is a view of the passenger vehicle after the life saving implement of the present invention is operated, FIG. 12 is a view illustrating the wire rope installed on an upper portion of the passenger vehicle before the wire rope is separated from the wire rope separator, and FIG. 13 is a view illustrating a state where the wire rope installed on the upper portion of the passenger vehicle is being separated from the wire rope separator.

Referring to FIGS. 10 through 13, the passenger vehicle 80 includes an upper frame 81, a bottom plate 82 defining the bottom of the passenger vehicle, pillars 83 connecting the upper frame 81 to the bottom plate 82, a sub-bottom plate 84 rotatably installed on a side portions of the pillars 83, and a hinge 85 defining a pivot axis of the sub-bottom plate 84.

The passenger vehicle 80 further includes a nonflammable member 87 covering outer surfaces of the upper frame 81 and the bottom plate 82 and a safety hook 88 located on the center of the nonflammable member 87 to close an opening of the nonflammable member 87.

Before the start handle 99 is pulled, the second wire rope 64 is pulled down by the load applied by the passengers in the passenger vehicle 80 and the pressure booster drum 62 rotates while the second wire rope 64 wound around the pressure booster drum 62 is released. In addition, the supporting rod 61 rotates together with the pressure booster drum 62, by which the third wire rope 65 connected to the supporting rod 61 is wound. At this point, the braking frame 17 connected to the third wire rope 65 ascends and the speed reduction frame 24 descends.

At this point, the compressive forces generated by the braking and speed reduction irregular pitch springs 16 and 23 are to be greater than the load applied by the passengers by the ratio of the supporting rod 61 to the pressure booster drum 62. By the compressive forces, the descending speed of the passenger vehicle 80 is controlled to be a safe speed until it stops.

Since the supporting rod 61 is not reversibly pulled by the one-way bearing 63, the third wire rope 65 wound around the supporting rod 61 is not released, thereby stopping the ascended braking frame 17 and the descended speed reduction frame 24. Thus, the irregular pitch springs 16 and 23 of the respective braking and speed reduction frames 17 and 24 maintains their compressive forces.

The passenger vehicle 80 further includes an electric light 90, a wire rope separator 100 to which the second wire rope 64 is coupled, and a coupling pin 101 mounted in the wire rope separator 100 and coupled to the second wire rope 64.

That is, the second wire rope 64 is coupled to the wire rope separator 100 by the coupling pin 101. When the coupling pin 101 is removed, the second wire rope 64 is separated from the wire rope separator 100.

The operation of the passenger vehicle will be now described.

In ordinary times when the life saving implement is not used, the sub-bottom plate 84 is disposed on a side surface of the pillars 85. When the life saving implement is used, the sub-bottom plate 84 is pivoted about the hinge 85 to be unfolded on a plane identical to the bottom plate 82. The wire rope 86 is connected to an end of the sub-bottom plate 84 and the upper frame 81 to support the sub-bottom plate 84.

When the sub-bottom plate 84 is unfolded, the inflammable member 87 covers the upper frame 81 and the bottom plates 82 and 84. In order to protect the passengers from the toxic gas or flame emitted from the windows of the lower floor, the inflammable member 87 may be designed to cover the entire passenger vehicle 80.

In addition, after the persons get on the passenger vehicle 80, when the safe hook 88 is locked, the outer circumference of the passenger vehicle 80 is covered by the nonflammable member 87.

In addition, when one of the passengers 99 pulls down the start handle 99, as shown in FIGS. 12 and 13, the coupling pin 101 is removed from the start handle 99. Then, while the second wire rope 64 is removed from the coupling pin 101, the second wire rope 64 is separated from the wire rope separator 100.

FIG. 14 is a view illustrating the wire rope wound around the winding drum.

A doubly-wound radius is determined to prevent the acceleration of gravity that is generated when the passenger vehicle 80 descends.

For reference, FIG. 14 shows a side view of the winding drum to illustrate a case where the load applied on an end of the wire rope is varied by the radius defined by winding the first wire rope 18 around the winding drum 12.

The first wire rope 18 is wound by many turns around the winding drum 12. A width of the winding drum 12 is preferably manufactured such that the first wire rope 18 can be doubly wound.

The winding drum will now be described using exampled numerical value. However, the exampled numerical value will be limit the scope of the present invention.

For example, when the life saving implement is for 75 m corresponding to 25-story apartment has the braking drum 13 having a width of 300 mm, the winding drums 12 provided on the both sides of the braking drum 13. Two first wire ropes 18 each having a width smaller by 20 mm are wound around the respective winding drums 12.

When the first wire rope 18 is wound around the corresponding winding drum 12 by 4 turns, another first wire rope 18 is doubly wound around the wound wire rope 18. Therefore, the diameter defined by the wire ropes is increased.

When the wire rope of 75 m is fully wound, 18 layers are formed. Therefore, the radius defined after the wire rope is fully wound is increased to 90 mm (18×5). As a result, the resultant radius is increased to 480 mm (300+90+90). That is, the radius defined by winding the first wire rope 18 is increased by 90 mm.

That is, the radius is increased by 1.6 times (480/300=1.6). In addition, the load B applied to the fully wound first wire rope 18 is increased by 1.6 times than that of the 300 mm-radius by the leverage theory.

That is, when the load applied by the passengers in the passenger vehicle 80 is 300 kg and the overall radius of the winding drum 12 is 300 mm, the braking force of the braking unit is controlled such that the descending speed of the passenger vehicle 80 is controlled to be 0.5 m/s. When the passenger vehicle 80 descends in a state where the radius defined by the wound first wire rope 18 is increased to 480 mm, the passenger vehicle descends at 0.8 m/s increased by 1.6 times as compared with when the radius is 300 mm.

In addition, by the radius reduced as the first wire rope 18 is released, the load and descending speed of the passenger vehicle are gradually reduced. Therefore, at a 300 mm-point where the first wire rope is fully released, the descending speed of the passenger vehicle is reduced to 0.5 m/s. As a result, the acceleration of gravity generated when the passenger vehicle 80 descends can be prevented but the descending speed is reduced.

FIG. 15 is a sectional view of a buffering device before the life saving implement of the present invention is operated and FIG. 16 is a sectional view of the buffering device after the life saving implement of the present invention is operated.

Referring to FIGS. 15 and 16, the buffering device 130 is installed in the braking drum 13. The buffering device 130 includes a buffer spring 131 having a predetermined spring coefficient, a hole 133 through which the first wire rope 18 is inserted into the braking drum 13, and a center rod 19 for fixing the braking drum 13 in the prime motor assembly 10.

That is, the first end of the wire rope 18 coupled to an end 132 of the buffer spring 131 extends out of the braking drum 13 through the hole 133 and is wound around the winding drum 12.

Tension applied to the first wire rope 18 by the loads of the passenger and the passenger vehicle 80 generates compressive force of the buffer spring 131.

The operation of the buffer device 130 will now described.

As the passenger vehicle approaches the ground, the wire rope 18 is almost released.

In addition, compressive force is applied to the buffer spring 131 while the first wire rope 18 is pulled downward. That is, the buffer spring 131 is compressed at left and right sides by the first wire rope 18 fixed on the end of the buffer spring 131.

By the descent of the passenger vehicle 80, the pulling down force of the first wire rope 18 is absorbed by the buffer spring 131.

Therefore, the passenger vehicle 80 can safely reach the ground.

FIG. 17 is a front view of the life saving implement of the present invention that is installed in a building, FIG. 18 is a rear view of the life saving implement of the present invention that is installed in a building, FIG. 19 is a side view of the life saving implement of the present invention that is installed in a building, FIG. 20 is a side view illustrating a state where the passenger vehicle and the prime motor assembly are installed on an outer side of a building, FIG. 21 is a detailed view of a portion I of FIG. 21, FIG. 22 is a side view illustrating a state where the passenger vehicle is descending by the operation of the life saving implement of the present invention, and FIG. 23 is a view illustrating an example where life saving implements of the present invention are simultaneously used in many stories.

Referring to FIGS. 17 through 23, the passenger vehicle 80 includes front and rear pillars 153 and 154, a door 156 pivotally mounted on a front portion of the front pillar 153, a handle 159 installed on the door 156, and a hinge rod 155 mounting the prime motor assembly 10 on the rear pillar 156.

The passenger vehicle 80 further includes a supporting plate 157 supporting the prime motor assembly 10, a cover 159 for protecting the handle 159 from outer impact, and a fixing unit 160 for preventing a lower portion of the prime motor assembly 10 from being moved into the building.

The passenger vehicle 80 further includes a roller 180 for guiding the first wire rope 18 downward.

The installation and operation of the life saving implement of the present invention will be now described.

The life saving implement is generally installed on the window or the veranda so that the outer appearance of the building is not deteriorated and the implement is not exposed to rain or snow.

That is, after removing a window frame or a portion of the veranda, the pillars 153 and 154 are installed on the between the concrete ceiling and the concrete bottom. Then, the prime motor assembly 10 is disposed on a middle portion of the pillar 154 and the hinge rod 155 is inserted through holes formed on both of the pillar 154 and the prime motor assembly 10.

The door 156 is installed on a middle portion of the front pillar 153 and the supporting plate 157 is installed on the door 156 so that the prime motor assembly 10 can be supported on the supporting plate 157.

In ordinary times, the primary motor 10 and the passenger vehicle 80 are in a fixed state. In use, when the door 156 is opened, the supporting plate 157 is removed and the bottom of the primary motor 10 and the passenger vehicle 80 are automatically moved out of the building by the weight center theory by the hinge rod 155.

The primary motor 10 moved out of the building cannot be reentered into the building by the hook step 162 formed on the rear pillar 154.

Referring to FIG. 21, an elastic member is installed on the rear pillar 154.

When the primary motor 10 pivots about the hinge rod 154, the lower frame of the motor body 11 moves along an outer surface of the rear pillar 154.

At this point, the hook step 162 is projected from the rear pillar 154 by the compressive force of the elastic member 161 and contacts the lower frame of the motor body 11. Accordingly, the reentering of the prime motor assembly 10 into the building can be prevented.

In addition, when one of the passengers in the passenger vehicle pulls down the start handle 99, the end of the second wire rope 64, which is fixed to the pressure booster drum 62 is separated from the wire rope separator 100.

Then, the passenger vehicle 80 descends by the first wire rope 18. That is, the winding drum 12 and the braking drum 13 rotates at a safe speed by the control of the braking unit 30 so that the first wire rope 18 can be safely released.

While the first wire rope 18 is released from the winding drum 12, the passenger vehicle 80 descends in a state where it is spaced apart from the outer wall of the building.

As shown in FIGS. 18 and 19, when the persons get on the passenger vehicle, the bottom plate 82 moves downward at a predetermined angle. A rubber wheel is installed on the rear surface of the bottom plate 82 so that the passenger vehicle 80 can move over any barrier projected from the outer wall of the building and absorb impact when the vehicle 80 collides with the outer wall by wind.

The above-described life saving implement can be effectively used when a family of more than two intends to escape out of a high-rise building at a time in an emergency.

[Industrial Applicability ]

Since the inventive life saving implement can be used at high-rise building more than 10-story, it can be effectively applied in many high-rise buildings.

The invention claimed is:

1. A life saving implement comprising:

a prime motor assembly having a motor body;

a winding drum installed in the prime motor assembly to wind a first wire rope;

a braking drum installed on a side of the winding drum to control an RPM of the winding drum;

a first braking unit installed on a lower portion of the braking drum to control an RPM of the braking drum;

a second braking unit installed on an upper portion of the braking drum to control the RPM of the braking drum; and a passenger vehicle connected to the first wire rope and moved by the rotation of the winding drum and the braking drum, wherein the first braking unit is configured to reduce a release speed of the first wire rope while the passenger vehicle descends, the first braking unit including:

a brake lining installed on a lower portion of the braking drum;

a braking spring installed on a lower portion of the braking lining; and a braking frame configured to generate compressive force of the braking spring, and wherein the second braking unit is configured to reduce a descending speed of the passenger vehicle when the passenger vehicle reaches a predetermined height from a ground, the second braking unit including:

a plurality of speed reduction linings installed on an upper portion of the braking drum and spaced away from the braking drum;

a plurality of springs configured to press the plurality of speed reduction linings one by one, to gradually reduce the RPM of the winding drum according to the height of the passenger vehicle;

a plurality of second wire ropes configured to support the plurality of speed reduction linings from the motor body, and having hook rings connected to the speed reduction linings;

a plurality of pins connected to the hook rings and formed to be removable to allow the speed reduction linings to contact the winding drum; and a plurality of third wire ropes located between the pins and the first wire rope, respectively, and configured to be hooked on the first wire rope in a sequence so as to draw the pins one by one.

2. The life saving implement according to claim 1, wherein the braking drum is installed on an inner surface of the prime motor assembly and the winding drum is installed on both sides of the braking drum.

3. The life saving implement according to claim 1, wherein the passenger vehicle is provided with a sub-bottom plate and covered with a nonflammable member.

4. A life saving implement comprising:

a prime motor assembly;

a passenger vehicle connected to the prime motor assembly by a first wire rope;

a winding drum around which the first wire rope is wound and which is installed in the prime motor assembly;

a first braking unit for controlling an RPM of the winding drum that rotates as the first wire rope is released;

a braking drum installed on an upper portion of the first braking unit and configured to rotate together with the winding drum;

a second braking unit for reducing the RPM of the winding drum when the passenger vehicle reaches a predetermined height from the ground; and a buffering unit for buffering the descent of the passenger vehicle, wherein the first braking unit is configured to reduce a release speed of the first wire rope while the passenger vehicle descends, the first braking unit including:

a brake lining installed on a lower portion of the braking drum;

a braking spring installed on a lower portion of the braking lining; and a braking frame configured to generate compressive forces of the braking spring through elevation by a second wire rope which is connected to the passenger vehicle, and wherein the second braking unit is configured to reduce a descending speed of the passenger vehicle when the passenger vehicle reaches a predetermined height from the ground, the second braking unit including:

a plurality of speed reduction linings installed on an upper portion of the braking drum and spaced away from the braking drum;

a plurality of springs configured to press the plurality of speed reduction linings one by one, to gradually reduce the RPM of the winding drum according to the height of the passenger vehicle;

a plurality of third wire ropes configured to support the plurality of speed reduction linings from the motor body, and having hook rings connected to the speed reduction linings;

a plurality of pins connected to the hook rings and formed to be removable to allow the speed reduction lining by being drawn; and a plurality of fourth wire ropes located between the pins and the first wire rope, respectively, and configured to be hooked on the first wire rope in a sequence so as to draw the pins one by one.

5. The life saving implement according to claim 4, wherein a hinge rod having a predetermined thickness is coupled to an upper portion of the prime motor assembly so that the prime motor assembly can be projected out of a building by the position of the hinge rod.

6. The life saving implement according to claim 5, wherein the prime motor assembly pivots about the hinge rod to be projected out of the building and reentering of the prime motor assembly into the building is prevented.

7. The life saving implement according to claim 4, wherein the speed reduction lining contacts a top surface of the braking drum when a wire ring is hooked on a knot formed on the fourth wire rope during braking.

8. The life saving implement according to claim 7, wherein the speed reduction force is generated by the speed reduction lining contacting the braking drum.

9. The life saving implement according to claim 4, further comprising a pressure booster unit provided with a one-way bearing for maintaining the compressive force of the springs and preventing a supporting rod, installed on an upper portion of the braking drum, from rotating in a reverse direction.

10. The life saving implement according to claim 9, wherein the pressure booster unit includes:

a pressure booster drum; and a start handle and a wire separator are mounted on the passenger vehicle, wherein the second wire rope is connected between the pressure booster drum and the passenger vehicle and is separated from the wire separator when the start handle is pulled down.

11. The life saving implement according to claim 4, wherein the winding drum is provided at an inside with a buffering unit for controlling the lowering speed of the passenger vehicle.

12. The life saving implement according to claim 11, wherein the buffering until includes a buffer spring and the second wire rope is fixed on an end of the buffer spring.

13. The life saving implement according to claim 12, wherein tension of the second wire rope, which is generated by the passenger vehicle, is not transmitted to the buffer spring.

* * * * *